US005729851A

United States Patent [19]

Hollander

[11] Patent Number: 5,729,851

[45] Date of Patent: Mar. 24, 1998

[54] SYSTEM OF PILLOWS HAVING DIFFERENT ELEVATIONS

[75] Inventor: Leo Hollander, Boca Raton, Fla.

[73] Assignee: Hollander Home Fashions Corp., Boca Raton, Fla.

[21] Appl. No.: 600,864

[22] Filed: Feb. 13, 1996

[51] Int. Cl.[6] ..... A47G 9/00

[52] U.S. Cl. ..... 5/636; 29/91.1; 53/459; 53/570

[58] Field of Search ..... 5/490, 636, 652, 5/637–645, 653; 29/91, 91.1; 53/521, 459, 570

[56] References Cited

U.S. PATENT DOCUMENTS 4,606,088 8/1986 Michaelsen et al. ..... 5/636
5,475,886 12/1995 Mintz ..... 5/636

*Primary Examiner*—Alexander Grosz
*Attorney, Agent, or Firm*—Lerner, David, Littenberg, Krumholz & Mentlik

[57] ABSTRACT

A series of pillows having about the same weight are formed with different heights by employing casings having a gusset between the top and bottom panels. Relatively narrow gussets produce casings having relatively small volumes, and relatively large gussets produce casings having relatively large volumes. For a given weight of fill material, the smaller the volume of the casing the higher the crown will be and the higher the overall height of the pillow will be. Pillows in the series having the greatest height can be formed with no gusset at all.

27 Claims, 1 Drawing Sheet

SYSTEM OF PILLOWS HAVING DIFFERENT ELEVATIONS

FIELD OF THE INVENTION

This invention relates to pillows, and more particularly to pillows having different heights as well as the methods for forming same. Still more particularly, the invention relates to a series of pillows having different heights but about the same weight.

BACKGROUND OF THE INVENTION

Sleeping problems are commonplace throughout the world, spanning all races and classes of people, and are responsible for numerous maladies which affect people on a daily basis. Thus, problems encountered during sleeping commonly result in muscle aches, headaches, stiff necks, congestion, respiratory ailments, and a variety of other symptoms. Not only do sleeping disorders manifest themselves physically, they are frequently responsible for mental difficulties as well, such as stress, tension, tiredness, irritability, mood changes, etc. While the problems attributed to sleeping difficulties have been well known for a long time, efforts to find an effective solution have been futile.

Oftentimes, a major portion of sleeping difficulties can be attributed to the use of a pillow. When a person lies or sleeps on a bed, the pillow keeps the person's head elevated above the top of the matress. The amount of elevation a person needs will depend upon the orientation in which the person sleeps, and thus all people do not require the same amount of elevation. For example, when a person sleeps on his or her stomach, the natural position of the head is close to the mattress, and thus this person will need a pillow providing only a small amount of head elevation. When a person sleeps on his or her back, the natural position of the head is farther from the mattress, and thus this person will need a pillow providing a greater degree of elevation to support his or her head in proper alignment with his or her torso. For persons sleeping on their sides, the natural position of the head is still farther from the mattress, and thus such persons will need pillows which provide an even greater amount of elevation so as to support their heads in the proper position. Thus, the degree of elevation provided by the pillow will have a significant impact on the person's comfort level—either too little or too much elevation will cause a person's head to be supported in an awkward position with respect to his or her torso, resulting in one or more of the aforementioned maladies.

One method for addressing this problem has been to manufacture a series of pillows having the same height, but with different degrees of firmness. Pillows having a low degree of firmness will readily compress, thereby supporting a person's head at a low elevation with respect to his or her torso. Such pillows are intended for use by stomach sleepers. Firm pillows, on the other hand, will better retain their shape, thereby supporting a person's head at a higher elevation with respect to his or her torso. Such pillows are intended to be used by side sleepers. Between these extremes, pillows having intermediate degrees of firmness may be fabricated to provide appropriate levels of support, and would be used, for example, by back sleepers.

A long-standing technique for forming pillows having different degrees of firmness has been to vary the amount of stuffing material used to fill the pillows. That is, using lesser amounts of stuffing material results in pillows which are soft and readily compressible. These pillows will progressively become both thicker and more firm as the amount of material stuffed into the casing is increased. However, these pillows will also become progressively heavier and more costly for a manufacturer to produce, package, inventory and distribute.

Thus, the need exists for pillows providing support at different heights so that they may eliminate the physical and mental maladies which have continuously been suffered by users of conventional pillows. Preferably, these pillows will all have about the same weight, and therefore will overcome the problems associated with providing pillows having different densities. In addition, there exists a need for a method which will enable these pillows to be inexpensively manufactured, packaged, shipped and displayed at a retail location.

SUMMARY OF THE INVENTION

The present invention addresses these needs.

One aspect of the present invention provides methods for making a series of pillows, each one of the pillows having a different height than the other ones of the pillows. In accordance with one method, a series of casings is provided, each casing including a gusset and a pair of panels connected to opposite sides of the gusset to define a cavity. Each one of the gussets has a selected width, the width of the gusset in each one of the casings being different than the width of the gusset in the remainder of the casings. Gussets having a width between about 0.50 inches and about 3 inches are preferred. Regardless of the width of the gusset, however, each of the casings preferably has about the same length girth and width girth. When each one of the casings is filled with about equal weights of a fill material, the pair of panels in the casings with relatively narrow gussets will bulge away from one another by greater amounts than the pair of panels in the casings with relatively wide gussets.

In another method according to this aspect of the invention, a series of casings is provided, one of the casings including a pair of opposed panels directly connected together along spaced joining lines to define a cavity, and the other ones of the casings each including a gusset and a pair of panels connected to opposite sides of the gusset to define a cavity. Each one of the gussets has a selected width, the width of the gusset in each one of the casings being different than the width of the gusset in the other ones of the casings. Gussets having a width between about 0.5 inches and about 3 inches are preferred. Again, the length girth and width girth of each of the casings is about equal regardless of the width of the gusset. When each one of the series of casings is filled with about equal weights of a fill material, the pair of panels in the casings with relatively narrow gussets will bulge away from one another by greater amounts than the pair of panels in the casings with relatively wide gussets, and the pair of panels in the one casing without a gusset will bulge away from one another by a greater amount than the pair of panels in the casings with gussets.

Another aspect of the present invention provides a set of pillows in which each pillow in the set desirably has about the same length and width girth, but a different height than the other ones of the pillows in the set. A first pillow has a casing including a gusset having a first width and a pair of panels connected to opposite sides of the gusset. A predetermined weight of a fill material is filled in the casing. At least one other pillow having a casing is also filled with the predetermined weight of the fill material. The casing of this other pillow includes a gusset having a second width greater than the first width and a pair of panels connected to opposite sides of the gusset, whereby the first pillow has an overall height which is greater than the overall height of the other pillow.

A still further aspect of the present invention provides a method for making a pillow having a predetermined height. In preferred methods according to this aspect of the invention, a series of casings is provided, each casing including a gusset and a pair of panels connected to opposite sides of the gusset to define a cavity. Each one of the gussets has a selected width, the width of the gusset in each one of the casings being different than the width of the gusset in the remaining ones of the casings. A selected one of the casings is then filled with a predetermined weight of a fill material, whereby the pair of panels in the selected casing will bulge away from one another by a predetermined amount to yield a pillow having the predetermined height.

The fill materials for use in connection with the present invention preferably are selected from the group consisting of feathers, down, polymer fibers, foam materials and combinations thereof. Desirably, each casing is filled with between about 12 ounces and about 60 ounces of the fill material.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
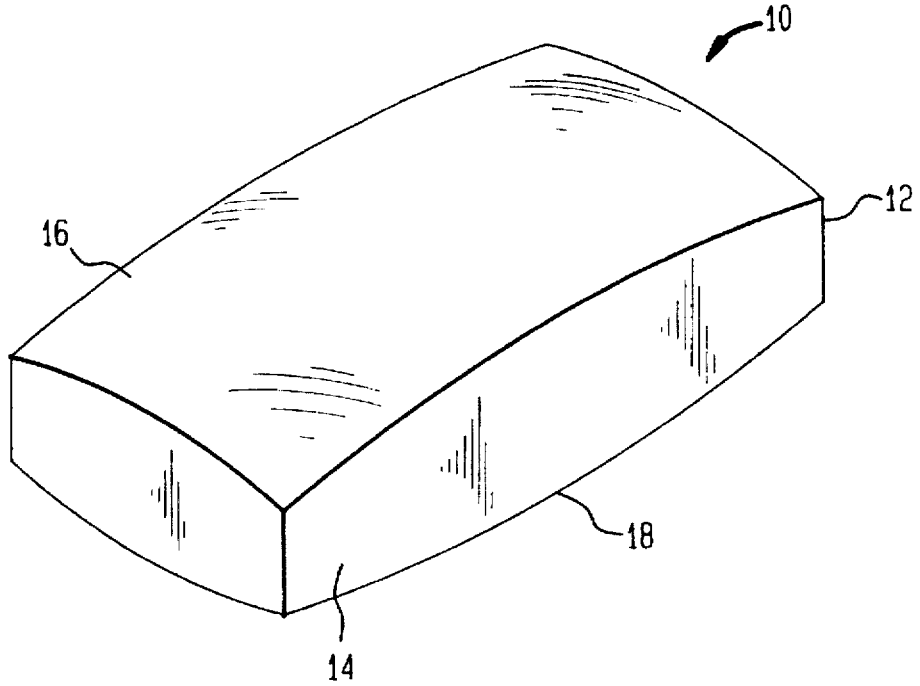
FIG. 1 is a perspective view of one embodiment of a pillow in accordance with the present invention.

Referring to FIG. 1, there is illustrated one preferred embodiment of a pillow 10 in accordance with the present invention. Pillow 10 typically has a conventional, essentially rectangular plan profile defined by an outer casing 12 which is formed from a gusset 14 and opposed sheets or panels of material 16 and 18 joined along peripheral edges to gusset 14 to define an interior cavity 20 therebetween. As discussed further hereinbelow, cavity 20 contains a fill material 30 which provides cushioning for the pillow 10. Gusset 14 and panels 16 and 18 may be formed from any soft, flexible material capable of retaining fill material 30 within cavity 20. Desirably, gusset 14 and panels 16 and 18 are formed from a textile fabric. The peripheral edges of panels 16 and 18 may be joined to gusset 14 by any conventional means capable of preventing the fill material 30 from escaping from cavity 20. Preferably, panels 16 and 18 are sewn along their peripheral edges to gusset 14 to provide outer casing 12 with superior structural integrity. Alternatively, one or more of the peripheral edges of casing 12 may be provided with a zipper, Velcro or other releasable fastener to provide access to interior cavity 20.

The fill material 30 in cavity 20 may consist of any materials commonly used to stuff pillows, cushions and the like. Such materials may include, for example, feathers, down, polymer fibers, foam materials, including foam rubber and urethane foams, and combinations of the foregoing. One preferred material is a combination of about 95 wt % feathers and about 5 wt % down. Also preferred are polyester fiber stuffing materials. Preferably, between about 12 ounces and about 60 ounces of fill material 30 are used to fill cavity 20, depending on the rectangular size of the pillow and the fill material used therein. Where fill materials consisting of about 95 wt % feathers and about 5 wt % down are used, a standard size pillow typically is stuffed with about 28 ounces of fill material. Where fill materials consisting of polymer fibers are being used, about 18 ounces of fill material typically is used to stuff a standard size pillow. It will be appreciated that greater amounts of fill material generally will be used for stuffing queen and king size pillows.

Figure 2:
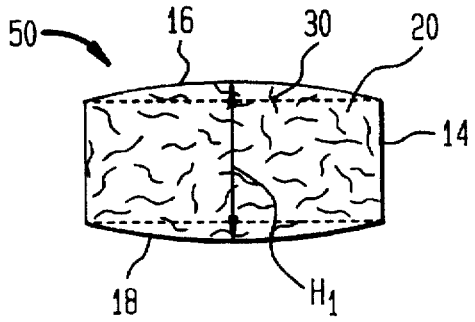
FIG. 2 is a highly schematic cross-sectional view of an embodiment of a pillow in accordance with the present invention having the lowest height.

In accordance with a preferred embodiment of the present invention, the overall height or thickness of pillow 10 may be altered merely by making small changes in the width and length of panels 16 and 18 and the width of gusset 14 without changing the width or length girth of pillow 10 or the weight of the fill material 30 placed in cavity 20. As used herein, the "width girth" of pillow 10 refers to the dimension around the outer periphery of the pillow in a direction perpendicular to the length of the pillow, and includes the width of panels 16 and 18 and two times the width of gusset 14. As used herein the "length girth" of pillow 10 refers to the dimension around the outer periphery of the pillow in a direction perpendicular to the width of the pillow, and includes the length of panels 16 and 18 and two times the width of gusset 14. The effect of these changes can best be seen with reference to FIGS. 2–4 which illustrate a series of pillows 50, 60 and 70 having progressively narrower gussets and thus progressively increasing overall thicknesses. More particularly, FIG. 2 shows a pillow 50 having a relatively wide gusset 14 and relatively small panels 16 and 18. Because gusset 14 is wide, the overall unfilled volume $V_1$ of pillow 50, shown in dashed lines in FIG. 2, is relatively large. Consequently, when cavity 20 of pillow 50 is filled with a predetermined weight W of fill material 30, panels 16 and 18 bulge outwardly by only a small amount to accommodate the fill material, yielding a pillow having an overall height $H_1$.

Figure 3:
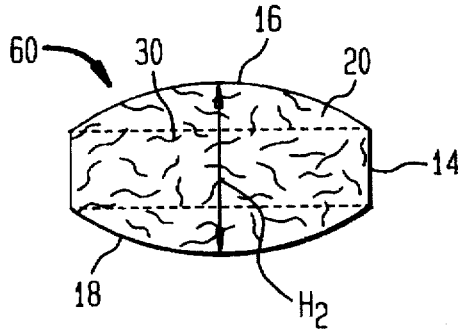
FIG. 3 is a highly schematic cross-sectional view of an embodiment of a pillow in accordance with the present invention which is higher than the pillow in FIG. 2.

FIG. 3 shows a pillow 60 having a gusset 14 which is narrower than the gusset of pillow 50 and panels 16 and 18 which are slightly larger in length and width than the same panels in pillow 50, such that pillow 60 has about the same length and width girths as pillow 50. As a result of having a thinner gusset, the overall unfilled volume $V_2$ of pillow 60, shown in dashed lines in FIG. 3, is smaller than the unfilled volume $V_1$ of pillow 50, such that filling cavity 20 of pillow 60 with the same predetermined weight W of fill material 30 causes a greater outward bulging of panels 16 and 18. The greater outward bulging of panels 16 and 18 more than compensates for the decreased width of gusset 14, with the result being that pillow 60 has a greater overall height $H_2$ than pillow 50.

Figure 4:
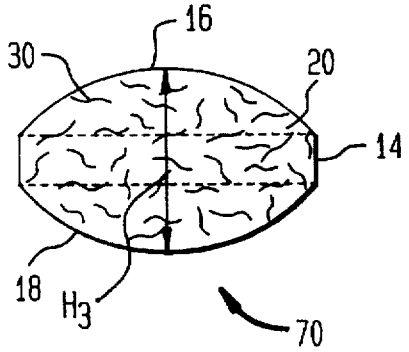
FIG. 4 is a highly schematic cross-sectional view of an embodiment of a pillow in accordance with the present invention which is higher than the pillow in FIG. 3.

Referring to FIG. 4, a pillow 70 is illustrated having a gusset 14 which is narrower than the gusset of pillow 60, and panels 16 and 18 which are slightly larger in length and width than the same panels in pillow 60, such that pillow 70 has about the same length and width girths as pillows 50 and 60. Since gusset 14 in pillow 70 is narrow, the overall unfilled volume $V_3$ of pillow 70, shown in dashed lines in FIG. 4, is smaller than the unfilled volume $V_2$ of pillow 60. Accordingly, when cavity 20 of pillow 70 is filled with the same predetermined weight W of fill material 30, panels 16 and 18 bulge outwardly to a great extent to accommodate all of the fill material. As the outward bulging of panels 16 and 18 more than offsets the decreased width of gusset 14, pillow 70 has a greater overall height $H_3$ than the heights of pillows 50 and 60.

Figure 5:
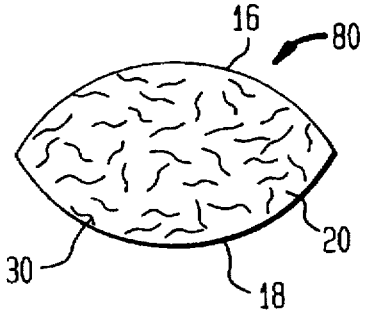
FIG. 5 is a highly schematic cross-sectional view of an embodiment of a pillow in accordance with the present invention having the greatest height.

Typically, the pillows of the present invention will be formed with gussets which are between about 0.50 inches wide and about 3 inches wide. It will be appreciated that the pillow having the greatest overall height in the series of pillows may be formed with no gusset at all. That is, panels 16 and 18 may be connected directly to one another along their peripheral edges as shown by pillow 80 in FIG. 5. In such event, panels 16 and 18 would be slightly wider and longer than panels 16 and 18 in pillow 70, such that pillow 80 would have about the same length and width girths as the other pillows 50, 60 and 70 in the series, but the smallest unfilled volume. Hence, when cavity 20 of pillow 80 is filled with the same predetermined weight W of fill material 30, panels 16 and 18 bulge outwardly to a greater extent than in the pillows having gussets, with the result that the height of pillow 80 is greater than that of the other pillows.

Also, the series of pillows need not consist of three pillows 50, 60 and 70 having gussets, and, optionally, one pillow not having a gusset, but may consist of any number of pillows, including at least two pillows having different heights, at least one of the pillows having a gusset between the opposed panels 16 and 18.

EXAMPLE

In one embodiment of the present invention, pillow 50 was formed from panels 16 and 18 having a length of about 23.5 inches and a width of about 17.5 inches, and a gusset 14 having a width of about 2.50 inches. Thus, pillow 50 had an unfilled width girth of about 40.0 inches (17.5+2.5+17.5+2.5), an unfilled length girth of about 52.0 inches (23.5+2.5+23.5+2.5), and an unfilled volume $V_1$ of about 1028 cubic inches (17.5×23.5×2.50). When filled with 28 ounces of a fill material consisting of 95 wt % feathers and 5 wt % down, panels 16 and 18 bulged outwardly only slightly, yielding a pillow 50 having an overall height of about 6.75 inches.

A pillow 60 having a height greater than that of pillow 50 was formed from panels 16 and 18 having a length of about 24.5 inches and a width of about 18.5 inches, and a gusset 14 having a width of about 1.50 inches. Pillow 60 thus had an unfilled width girth of about 40.0 inches (18.5+1.5+18.5+1.50), an unfilled length girth of about 52.0 inches (24.5+1.50+24.5+1.50), and an unfilled volume $V_2$ of about 680 cubic inches (18.5×24.5×1.50). Filling pillow 60 with 28 ounces of the 95 wt % feathers/5 wt % down fill material caused panels 16 and 18 to bulge outwardly to a greater extent than in pillow 50 so as to produce a pillow 60 having an overall height of about 7.25 inches.

A pillow 70 having a still greater height was formed from panels 16 and 18 having a length of about 25.5 inches and a width of about 19.5 inches, and a gusset 14 having a width of about 0.5 inches. This yielded a pillow 70 having an unfilled width girth of about 40.0 inches (9.5+0.50+19.5+0.50), an unfilled length girth of about 52.0 inches (25.5+0.5+25.5+0.5), and an unfilled volume $V_3$ of about 249 cubic inches (19.5×25.5×0.50). When filled with 28 ounces of the 95 wt % feathers/5 wt % down fill material, panels 16 and 18 bulged outwardly to a still larger extent, whereupon the resultant pillow 70 had an overall height of about 8.0 inches.

Although the invention herein has been described with reference to particular embodiments, it is to be understood that these embodiments are merely illustrative of the principles and applications of the present invention. It therefore is to be understood that numerous modifications may be made to the illustrative embodiments and that other arrangements may be devised without departing from the spirit and scope of the present invention as set forth in the appended claims.

I claim:

1. A method for making a series of pillows, each one of said pillows having a different height than the other ones of said pillows, said method comprising the steps of:

providing a series of casings, each casing including a gusset and a pair of panels connected to opposite sides of said gusset to define a cavity, each one of said gussets having a selected width, said width of said gusset in each one of said casings being different than said width of said gusset in the remainder of said casings, providing a fill material, and filling each one of said series of casings with about equal weights of said fill material, whereby said pair of panels in said casings with relatively narrow gussets will bulge away from one another by greater amounts than said pair of panels in said casings with relatively wide gussets.

2. The method as claimed in claim 1, wherein said series of pillows includes at least three pillows.

3. The method as claimed in claim 1, wherein said fill material is selected from the group consisting of feathers, down, polymer fibers, foam materials and combinations thereof.

4. The method as claimed in claim 1, wherein said gussets have a width between about 0.5 inches and about 3 inches.

5. The method as claimed in claim 1, wherein each one of said series of casings is filled with between about 12 ounces and about 60 ounces of said fill material.

6. The method as claimed in claim 5, wherein each one of said series of casings is filled with about 18 ounces of said fill material.

7. The method as claimed in claim 5, wherein each one of said series of casings is filled with about 28 ounces of said fill material.

8. The method as claimed in claim 1, wherein each one of said casings has a width girth dimension, said width girth dimension in each one of said casings being about equal.

9. The method as claimed in claim 8, wherein each one of said casings has a length girth dimension, said length girth dimension in each one of said casings being about equal.

10. A method of making a series of pillows, each one of said pillows having a different height than the other ones of said pillows, said method comprising the steps of:

providing a series of casings, one of said casings including a pair of opposed panels directly connected together along spaced joining lines to define a cavity, and the other ones of said casings each including a gusset and a pair of panels connected to opposite sides of said gusset to define a cavity, each one of said gussets having a selected width, said width of said gusset in each one of said casings being different than said width of said gusset in the other ones of said casings, providing a fill material, and filling each one of said series of casings with about equal weights of said fill material, whereby said pair of panels in said casings with relatively narrow gussets will bulge away from one another by greater amounts than said pair of panels in said casings with relatively wide gussets, and said pair of panels in said one casing will bulge away from one another by a greater amount than said pair of panels in said casings with gussets.

11. The method as claimed in claim 10, wherein said gussets have a width between about 0.5 inches and about 3 inches.

12. The method as claimed in claim 10, wherein each one of said series of casings is filled with between about 12 ounces and about 60 ounces of said fill material.

13. The method as claimed in claim 10, wherein each one of said casings has a width girth dimension, said width girth dimension in each one of said casings being about equal.

14. The method as claimed in claim 13, wherein each one of said casings has a length girth dimension, said length girth dimension in each one of said casings being about equal.

15. A set of pillows in which each pillow in said set has a different height than the other ones of said pillows in said set, said set of pillows comprising a first pillow having a casing and a predetermined weight of a fill material in said casing, said casing including a gusset having a first width and a pair of panels connected to opposite sides of said gusset, at least one other pillow having a casing and said predetermined weight of said fill material in said casing, said casing including a gusset having a second width greater than said first width and a pair of panels connected to opposite sides of said gusset, whereby said first pillow has an overall height which is greater than the overall height of said at least one other pillow.

16. The set of pillows as claimed in claim 15, wherein said fill material is selected from the group consisting of feathers, down, polymer fibers, foam materials and combinations thereof.

17. The set of pillows as claimed in claim 15, wherein said predetermined weight of said fill material is between about 12 ounces and about 60 ounces.

18. The set of pillows as claimed in claim 17, wherein said predetermined weight of said fill material is about 18 ounces.

19. The set of pillows as claimed in claim 17, wherein said predetermined weight of said fill material is about 28 ounces.

20. The set of pillows as claimed in claim 15, wherein said gussets have a width between about 0.5 inches and about 3 inches.

21. The set of pillows as claimed in claim 15, wherein each one of said casings has a width girth dimension, said width girth dimension in each one of said casings being about equal.

22. The set of pillows as claimed in claim 21, wherein each one of said casings has a length girth dimension, said length girth dimension in each one of said casings being about equal.

23. A method of making a pillow having a predetermined height, comprising the steps of:

providing a predetermined weight of a fill material, providing a series a casings, each casing including a gusset and a pair of panels connected to opposite sides of said gusset to define a cavity, each one of said gussets having a selected width, said width of said gusset in each one of said casings being different than said width of said gusset in the remaining ones of said casings, selecting one of said series of casings so that said selected one of said casings will have said predetermined height when filled with said predetermined weight of said fill material, and filling said selected one of said casings with said predetermined weight of said fill material, whereby said pair of panels in said selected one of said casings will bulge away from one another by a predetermined amount to yield a pillow having said predetermined height.

24. The method as claimed in claim 23, wherein said predetermined weight of said fill material is between about 12 ounces and about 60 ounces.

25. The method as claimed in claim 23, wherein said gussets have a width between about 0.5 inches and about 3 inches.

26. The method as claimed in claim 23, wherein each one of said casings has a width girth dimension, said width girth dimension in each one of said casings being about equal.

27. The method as claimed in claim 26, wherein each one of said casings has a length girth dimension, said length girth dimension in each one of said casings being about equal.

* * * * *

UNITED STATES PATENT AND TRADEMARK OFFICE

CERTIFICATE OF CORRECTION

PATENT NO. : 5,729,851

DATED : March 24, 1998

INVENTOR(S) : Hollander

It is certified that error appears in the above-identified patent and that said Letters Patent is hereby corrected as shown below:

Column 5, line 59, "(9.5" should read --(19.5--.

Column 8, line 15, "a" should read --of--.

Signed and Sealed this

Twenty-first Day of July, 1998

*Attest:*

*Attesting Officer*

BRUCE LEHMAN

*Commissioner of Patents and Trademarks*